US005839908A

United States Patent [19]

Bonilla et al.

[11] Patent Number: 5,839,908

[45] Date of Patent: Nov. 24, 1998

[54] MULTI-CONTACT ELECTRICAL TERMINAL FOR ELECTRICAL RECEPTACLE ASSEMBLY

[75] Inventors: Nelson Bonilla, West Haven; Thomas J. Vigorito, Fairfield, both of Conn.

[73] Assignee: Hubbell Incorporated, Orange, Conn.

[21] Appl. No.: 953,451

[22] Filed: Oct. 17, 1997

[51] Int. Cl.[6] ..... H01R 13/648

[52] U.S. Cl. ..... 439/107; 439/860; 439/857

[58] Field of Search ..... 439/100, 107, 439/857, 860

[56] References Cited

U.S. PATENT DOCUMENTS

| | | | |
|---|---|---|---|
| 4,317,609 | 3/1982 | Lapraik | 439/857 |
| 4,521,824 | 6/1985 | Morris et al. | 361/45 |
| 4,872,081 | 10/1989 | Murphy et al. | 361/117 |
| 4,872,087 | 10/1989 | Brant | 361/356 |
| 5,266,039 | 11/1993 | Boyer et al. | 439/107 |
| 5,281,154 | 1/1994 | Comerci et al. | 439/107 |
| 5,510,760 | 4/1996 | Marcou et al. | 335/18 |

*Primary Examiner*—Neil Abrams
*Assistant Examiner*—Brian J. Biggi
*Attorney, Agent, or Firm*—Jerry M. Presson; Michael R. Swartz

[57] ABSTRACT

A multi-contact electrical terminal includes a body member and attachment member made of a substantially resilient flexible electrically conductive material. The body member includes a pair of opposite contact walls defining a central passageway through the body member and providing respective pairs of spaced upper and lower opposed portions along opposite sides of the central passageway, and a pair of opposite support straps provided between and connected with one of the pairs of upper and lower opposed portions of the opposite contact walls. A male prong of an electrical plug is receivable through the central passageway of the body member. The upper and lower opposed portions of the opposite contact walls receive the male plug initially between the upper opposed portions and subsequently between the lower opposed portions such that a complete insertion of the male prong into the central passageway provides the male prong in electrical contact at the four separate spaced apart portions of the body member of the electrical terminal.

9 Claims, 2 Drawing Sheets

MULTI-CONTACT ELECTRICAL TERMINAL FOR ELECTRICAL RECEPTACLE ASSEMBLY

CROSS-REFERENCE TO RELATED APPLICATION

Certain subject matter disclosed in this application relates to the invention claimed in a copending patent application entitled "Electrical Receptacle Assembly With Multiple Sites of Dual Snap-Fit Securement Means" designated Ser. No. 08/953,452, filed Oct. 17, 1997, which is assigned to the same assignee as this application.

BACKGROUND OF THE INVENTION

1. Field of the Invention

The present invention generally relates to electrical receptacle assemblies and, more particularly, is concerned with a multi-contact electrical terminal for an electrical receptacle assembly.

2. Description of the Prior Art

Heretofore, many electrical receptacles manufactured and marketed by Hubbell Incorporated of Orange, Connecticut, the assignee of the subject application, have employed a housing formed by separate mateable front and back covers, and a mounting bridge having upper and lower ears attachable to a suitable mounting structure, such as a building wall by the use of suitable fasteners, such as screws or the like, to hold the housing in a mounted relationship relative to the structure. Also, the electrical receptacle assembly has female electrical terminals mounted within the housing for receiving and making electrical contact with male prongs of an electrical plug inserted through openings in the front cover of the housing.

Typically, these female electrical terminals are flexible strips made of electrically conductive material formed in an U-shape in which opposite leg portions are spread apart and make electrical contact with opposite side portions of the prong of the electrical plug. Such electrical contact is made with the two opposing inside surface areas at about the middle of the leg portions of the electrical terminal. Various designs of electrical terminals are known in the prior art. For example, several designs of such terminals are disclosed in U.S. Pat. No. 4,872,081 to Murphy et al, U.S. Pat. No. 4,872,087 to Brant, and U.S. Pat. No. 5,510,760 to Marcou et al. While these prior art terminal designs may appear to operate satisfactorily for the specific purposes for which they were designed, they are not seen as providing an optimum solution to the problem of achieving an enhanced form of electrical contact between the prongs of an electrical plug and the electrical terminals of an electrical receptacle assembly.

Consequently, a need still remains for an improved design which provides a solution to the aforementioned problem without introducing any new problems in place thereof.

SUMMARY OF THE INVENTION

The present invention provides a multi-contact electrical terminal designed to satisfy the aforementioned needs. The multi-contact electrical terminal of the present invention is adapted, although not so limited, for employment as a ground terminal within an electrical receptacle assembly. The multi-contact electrical terminal of the present invention defines twice the number of electrical contact portions on the terminal than are normally found on prior art electrical terminals.

Accordingly, the present invention is directed to a multi-contact electrical terminal which comprises a body member defining a central passageway for receiving a male prong of an electrical plug, the body member including a pair of spaced apart upper opposed portions disposed on opposite sides of the central passageway for receiving the male prong of the electrical plug therebetween and making electrical contact therewith and a pair of spaced apart lower opposed portions disposed on opposite sides of the central passageway for receiving the male prong of the electrical plug therebetween and for making electrical contact therewith after electrical contact is made with the pair of spaced apart upper opposed portions such that complete insertion of the male prong of the electrical plug into the central passageway provides electrical contact of the male prong with at least four separate spaced apart portions of the body member of the electrical terminal. The body member is made of a substantially resilient flexible electrically conductive material and formed from a single substantially planar blank of material.

The body member also includes a pair of opposite support straps disposed between and on opposite sides of the upper and lower opposed portions and is connected to one of the pairs of upper and lower opposed portions such that partial insertion of the male prong of the electrical plug through the central passageway between the upper opposed portions causes the upper opposed portions to move away from one another as the lower opposed portions move toward one another relative to the support straps and such that complete insertion of the male prong of the electrical plug through the central passageway causes the upper opposed portions to move toward one another as the lower diametrically opposed portions are moved away from one another relative to the support straps to thereby provide electrical contact of the male prong of the electrical plug with at least four separate spaced apart portions of the body member of the electrical terminal.

The electrical terminal further comprises an attachment member connected to one of the support straps of the body member for fastening the body member to a mounting member disposed within an electrical receptacle assembly. The attachment member defines a hole for receiving a fastener therethrough.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
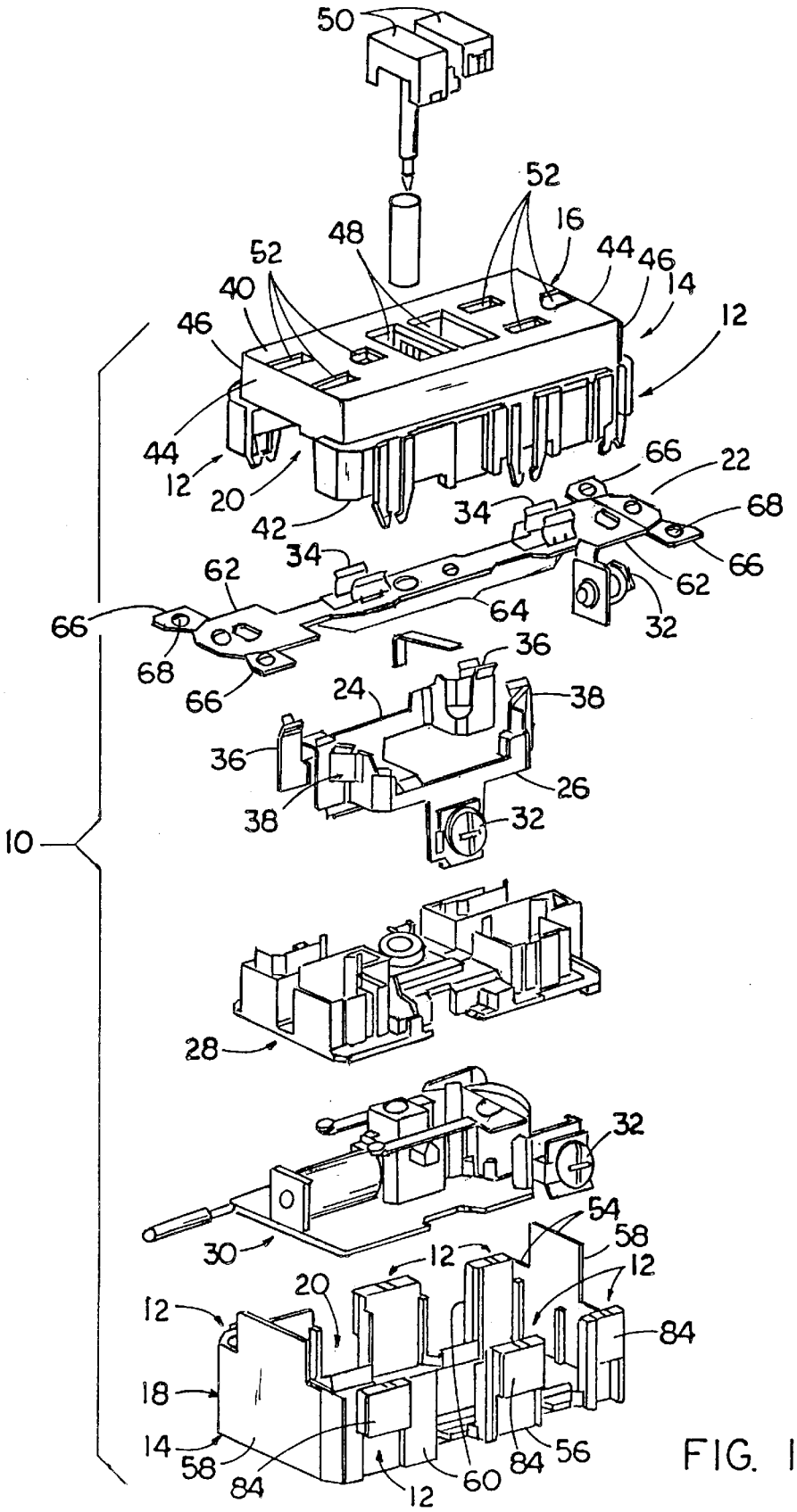
FIG. 1 is an exploded perspective view of an electrical receptacle assembly employing the multi-contact electrical terminals of the present invention.
Figure 2:
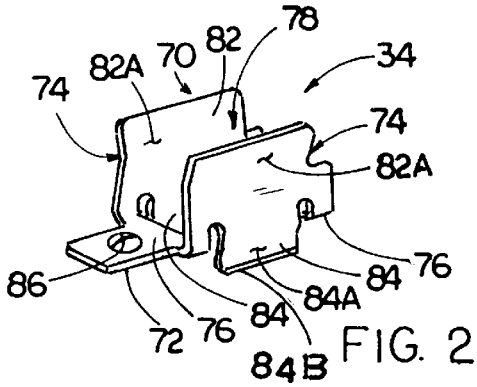
FIG. 2 is an enlarged perspective view of the multi-contact electrical terminal of the present invention.
Figure 5:
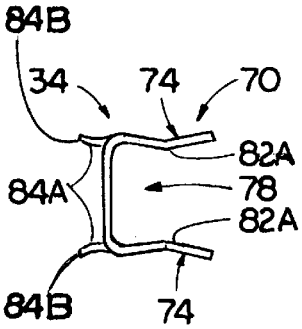
FIG. 5 is an end elevational view of the electrical terminal taken along lines 5—5 of FIG. 3.
Figure 3:
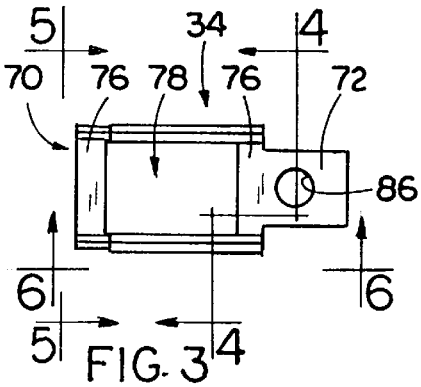
FIG. 3 is a top plan view of the electrical terminal of FIG. 2.
Figure 4:
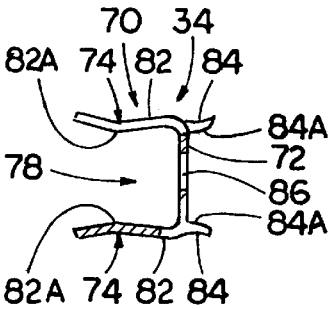
FIG. 4 is a sectional view of the electrical terminal taken along line 4—4 of FIG. 3.
Figure 6:
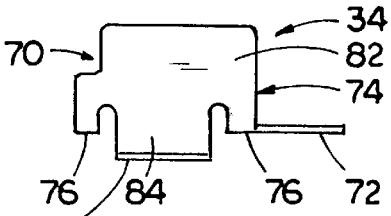
FIG. 6 is a side elevational view of the electrical terminal taken along lines 6—6 of FIG. 3.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated an electrical receptacle assembly, generally designated 10, employing a pair of multi-contact electrical terminals 34 in accordance with the present invention. The electrical terminals 34 can be used in electrical receptacle assemblies adapted for various applications. By way of example, the application illustrated in the drawings is an electrical receptacle assembly for a ground fault circuit interrupt unit or the like.

The electrical receptacle assembly 10 basically includes a two-piece housing 14 having a front cover 16 and a back cover 18. The back cover 18 is separate from and mateable with the front cover 16. When the front and back covers 16, 18 are disposed in an interfitted mated relationship with one another, the housing 14 has a substantially rectangular shape, although other shapes are equally possible, and defines an interior cavity 20 enclosing electrical components. Additionally, when the front and back covers 16, 18 are disposed in the interfitted mated relationship, they are interlocked to one another by a plurality of spaced apart dual snap-fit securement means 12 attached on the front and back covers 16, 18. The dual snap-fit securement means 12 comprises the subject matter of the invention claimed in the patent application cross-referenced above. Further detailed description of such securement means 12 is not necessary herein for gaining a clear and thorough understanding of the present invention. The assembly 10 also includes a mounting bridge 22 which is substantially flat in shape, although other shapes are equally possible, and is sandwiched between the front and back covers 16, 18 of the housing 14 when in an assembled condition.

Other components of the receptacle assembly 10, which are disposed in the interior cavity 20 of the housing 14 when the front and back covers 16, 18 are in the assembled condition, include a pair of conductor plates 24, 26, an insulative support member 28, and a printed circuitboard 30 with various solid state components making up the ground fault interrupt circuitry. The mounting bridge 22, one conductor plate 26 and support member 28 have screws 32 for connecting thereto the bare ends of respective ground, hot and neutral conductor wires. The mounting bridge 22 also supports ground terminals which take the form of the multi-contact electrical terminals 34 of the present invention while the conductor plates 24, 26 support respective hot and neutral electrical terminals 36, 38 for receiving the corresponding prongs of an electrical plug (not shown).

The front cover 16 of the housing 14 has opposite forward and rearward sides 40, 42, opposite top and bottom end walls 44 and opposite lateral side walls 46, all of which are integrally connected together. The forward side 40 of the front cover 16 defines openings 48 for receiving elements such as pushkeys 50 mounted on the circuitboard 30 disposed in the interior cavity 20 of the housing 14 and apertures 52 for receiving prongs of electrical plugs (not shown) for mating with the aforementioned electrical terminals 34, 36, 38. The openings 48 and apertures 52 may have any suitable dimensions. The forward side 40 of the front cover 16 is in the form of a wall which substantially closes the same. On the other hand, the rearward side 42 of the front cover 16 is substantially open. The back cover 18 of the housing 14 has opposite forward and rearward sides 54, 56, opposite top and bottom end walls 58 and opposite lateral side walls 60, all of which are integrally connected together. The forward side 54 of the back cover 18 is open, whereas the rearward side 56 of the back cover 18 is in the form of a wall which substantially closes the same. The open forward side 54 of the back cover 18 is adapted to interfit with the open rearward side 42 of front cover 16 to provide them in the mated relationship with one another and with the mounting bridge 22 sandwiched therebetween. The front and back covers 16, 18 of the housing 14 are comprised of a substantially rigid plastic material, but may be made of any other suitable material. Each of the dual snap-fit securement means 12 includes interlocking components which are attached specifically on respective lateral side walls 46, 60 of the front and back covers 16, 18 of the housing 14.

The mounting bridge 22 has a pair of opposite end portions 62 and a middle portion 64 being disposed between and interconnected to the pair of opposite end portions 62. Each opposite end portion 62 has a pair of ears 66 for attachment of the assembly 10 to the external structure. Each ear 66 defines an annular hole 68 for receiving a suitable fastener, such as a screw or the like. The mounting bridge 22 is generally securable between the front and back covers 16, 18 of the housing 14 such that the middle portion 64 of the mounting bridge 22 is disposed within the interior cavity 20 defined by the front and back covers 16, 18 of the housing 14 while each of the opposite end portions 62 of the mounting bridge 22 protrudes externally from between the front and back covers 16, 18 of the housing 14. The mounting bridge 22 is comprised substantially of metal, but may be made of any other suitable material.

Referring to FIGS. 2–9, there is illustrated one of the multi-contact electrical terminals 34 of the present invention. The electrical terminal 34 while shown in use as a ground terminal it is not so limited in its applications. Each electrical terminal 34 includes a body member 70 and an attachment member 72 made of a substantially resilient flexible electrically conductive conventional material. More particularly, the body member 70 includes a pair of opposite contact walls 74 disposed in substantially parallel relation to one another and a pair of opposite support straps 76 disposed in substantially parallel relation to one another and between and in substantially perpendicular relation to and interconnecting the pair of opposite contact walls 74. Further, the pair of opposite contact walls 74 are disposed in spaced apart relationship and define a central passageway 78 therebetween through the body member 70 for receiving a male prong 80 (see FIGS. 7–9) of a conventional electrical plug (not shown) therebetween.

Figure 7:
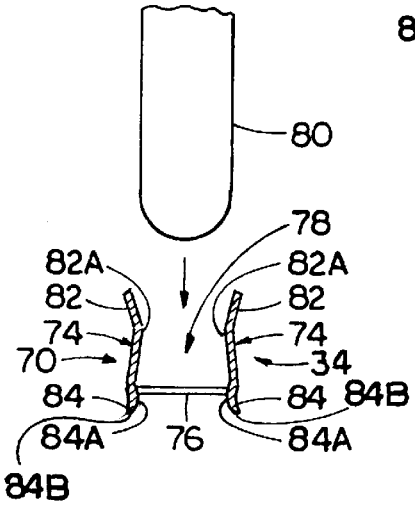
FIGS. 7–9 are diagrammatic views of a sequence of positions of a male prong of an electrical plug being inserted into and making multiple contacts with the electrical terminal of the present invention.
Figure 8:
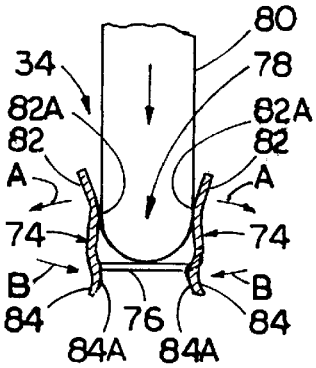
Figure 9:
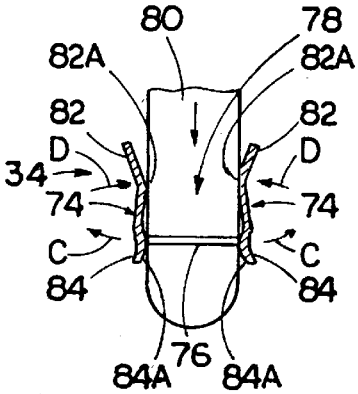

More particularly, the opposite contact walls 74 of the body member 70 form a pair of spaced apart upper diametrically opposed portions 82 and a pair of spaced apart lower diametrically opposed portions 84. The pair of upper opposed portions 82 are disposed along opposite sides of the central passageway 78 above the support straps 76 for receiving the male prong 80 therebetween upon an initial insertion of the male prong 80 from a position above the terminal 34, as shown in FIG. 7, to the initial insertion position, as shown in FIG. 8, to make an initial electrical contact therewith. The pair of lower opposed portions 84 are disposed along the opposite sides of the central passageway 78 below the support straps 76 for receiving the male prong 80 therebetween upon a complete insertion of the male prong 80 from the initial insertion position, as shown in FIG. 8, to the complete insertion position, as shown in FIG. 9, to make a subsequent electrical contact therewith after the initial electrical contact is made with the upper opposed portions 82.

The opposite support straps 76 are disposed in a spaced apart and substantially parallel relationship to one another and between and in substantially perpendicular relationship to the opposite contact walls 74. More particularly, the support straps 76 are provided between and connected with one of the pairs of upper and lower opposed portions 82, 84 of the opposite contact walls 74 and preferably with the pair of upper opposed portions 82 such that the complete insertion of the male prong 80 through the central passageway 78 provides electrical contact of the male prong 80 with at least four separate spaced apart portions of the body member 70 of the electrical terminal 34. The connections between the support straps 76 and upper opposed portions 82 of the contact walls 74 permits a bending at such connections accommodating a pivotal movement of the walls 74 relative to the support straps 76 in response to insertion of the male prong 80 through the central passageway 78 of the body member 70.

As seen in FIG. 7, the upper and lower opposed portions 82, 84 of the contact walls 74 have concave or slightly shallow V-shaped configurations at substantially middle sections 82A, 84A of the upper and lower opposed portions 82, 84 of the contact walls 74. More particularly, the concave or slightly shallow V-shaped configuration of the upper and lower opposed portions 82, 84 is such that each wall of the upper opposed portions 82 extends upwardly from the support straps 76 and are bent slightly inwardly toward one another to the middle sections 82A, wherein the upper opposed portions are spaced the closest distance apart, and then from the middle sections 82A, the upper opposed portions 82 extend upwardly and are bent slightly outwardly away from one another so as to facilitate insertion of the male prong 80 therein. In like fashion, each wall of the lower opposed portions 84 extend downwardly from the support straps 76 and are bent slightly inwardly toward one another to the middle sections 84A, wherein the lower opposed portions are spaced the closest distance apart, and then from the middle sections 84A, the lower opposed portions 84 extend downwardly and are bent slightly outwardly away from one another such that the lower terminal ends 84B of the lower opposed portions 84 are spaced apart a greater distance than the distance between the opposed middle sections 84A so as to facilitate removal of the male prong 80 from the body member 70 of terminal 34 after insertion thereof. At such middle sections 82A, 84A, the upper and lower opposed portions 82, 84 are spaced apart at distances less than the width of the male prong 80. The placement of the opposite support straps 76 between the upper and lower opposed portions 82, 84 but with their connection to only one, that being, the upper opposed portions 82 of the contact walls 74, results, first, in the forceable spreading apart of the upper opposed portions 82 from one another in the directions of arrows A in FIG. 8, causing the lower opposed portions 84 to move toward one another in the direction of arrows B in FIG. 8, upon the partial insertion of the male prong 80 through the central passageway 78 initially between the upper opposed portions 82 of the contact walls 74. Then, upon the complete insertion of the male prong 80 through the central passageway 78 subsequently between the lower opposed portions 84 of the contact walls 74 results in the forceable spreading apart of the lower opposed portions 84 from one another in the directions of arrows C in FIG. 9, causing the upper opposed portions 82 to move toward one another in the directions of arrows D in FIG. 9. The contact forces created between the male prong 80 and the upper and lower opposed portions 82, 84 of the contact walls 74 produce an improved electrical contact with the male prong 80 at the four separate spaced apart portions 82, 84 of the body member 70.

The attachment member 72 of the terminal 34 is provided for fastening the body member 70 to an external mounting member, such as the mounting bridge 22 shown in FIG. 1, for disposition within the electrical receptacle assembly 10. The attachment member 72 preferably, but not necessarily, is integrally formed with one of the support straps 76 and is disposed in the same plane as both of the support straps 76. The body member 70 and preferably the attachment member 72 therewith are formed using conventional fabrication techniques from a single substantially planar blank of material. The contact walls 74 and the attachment member 72 are substantially rectangular in shape, but may have any other suitable configuration. The attachment member 72 defines a hole 86 for receiving a fastener (not shown) therethrough.

It is thought that the present invention and many of its attendant advantages will be understood from the foregoing description and it will be apparent that various changes may be made thereto without departing from the spirit and scope of the invention or sacrificing all of its material advantages, the form hereinbefore described being merely preferred or exemplary embodiment thereof.

It is claimed:

1. A multi-contact electrical terminal for an electrical receptacle assembly, said terminal comprising:

(a) a body member defining a central passageway for receiving a male prong of an electrical plug;

(b) said body member including (i) a pair of space apart upper opposed portions disposed along opposite sides of said central passageway for receiving the male prong of the electrical plug therebetween to make an initial electrical contact therewith upon a partial insection of the male prong into said central passageway, each one of said pair of upper opposed portions having a slightly shallow V-shaped configuration formed at a middle section thereof and disposed such that the distance between said upper portions at said middle sections is the closest distance between said spaced-apart upper opposed portions so as to facilitate insertion of the male prong into said terminal (ii) a pair of spaced apart lower opposed portions disposed along opposite sides of said central passageway for receiving the male prong of the electrical plug therebetween to make a subsequent electrical contact therewith after said initial electrical contact is made with said pair of spaced apart upper opposed portions such that a complete insertion of the male prong of the electrical plug into the central passageway provides electrical contact of the male prong with at least four separate spaced apart portions of said body member of said electrical terminal, each one of said pair of lower opposed portions having a slightly shallow V-shaped configuration formed at a middle section thereof and disposed such that the distance between said lower portions at said middle sections is the closest distance between said spaced-apart lower opposed portions so as to facilitate removal of the male prong inserted in said terminal and (iii) a pair of opposite support straps disposed between said upper and lower opposed portions and connected to one of said pairs of upper and lower opposed portions such that partial insertion of the male prong of the electrical plug through said central passageway between said upper opposed portions causes said upper opposed portions to move away from one another as said lower opposed portions move toward one another and such that the complete insertion of the male prong of the electrical plug through said central passageway causes said upper opposed portions to move toward one another as said lower opposed portions are moved away from one another by the male prong to thereby provide said electrical contact of the male prong of the electrical plug with said four separate spaced apart portions of said body member of said electrical terminal.

2. The electrical terminal as recited in claim 1, wherein said body member is made of a substantially resilient flexible electrically conductive material.

3. The electrical terminal as recited in claim 2, wherein said body member is formed from a single substantially planar blank of material.

4. The electrical terminal as recited in claim 1, further comprising:

an attachment member connected to one of said support straps of said body member for fastening said body member to a mounting member disposed within the electrical receptacle assembly.

5. The electrical terminal as recited in claim 4, wherein said attachment member defines a hole for receiving a fastener therethrough.

6. A multi-contact electrical terminal for an electrical receptacle assembly, said terminal comprising:

(a) a body member made of a substantially resilient flexible electrically conductive material;

(b) said body member including (i) a pair of opposite contact walls being spaced apart and disposed in substantially parallel relation to one another and defining a central passageway therebetween for receiving a male prong of an electrical plug, (ii) a pair of spaced apart upper opposed portions formed on said opposite contact walls and disposed along opposite sides of said central passageway for receiving the male prong of the electrical plug therebetween to make an initial electrical contact therewith upon a partial insertion of the male prong into said central passageway, each one of said pair of upper opposed portions having a slightly shallow V-shaped configuration formed at a middle section thereof and disposed such that the distance between said upper portions at said middle sections is the closest distance between said spaced-apart upper opposed portions so as to facilitate insertion of the male prong into said terminal, (iii) a pair of spaced apart lower opposed portions formed on said opposite contact walls and disposed along opposite sides of said central passageway for receiving the male prong of the electrical plug therebetween to make a subsequent electrical contact therewith after said initial electrical contact is made by the male prong with said pair of spaced apart upper opposed portions, each one of said pair of lower opposed portions having a slightly shallow V-shaped configuration formed at a middle section thereof and disposed such that the distance between said lower portions at said middle sections is the closest distance between said spaced-apart lower opposed portions so as to facilitate removal of the male prong inserted in said terminal, and (iv) a pair of opposite support straps spaced apart and disposed in substantially parallel relation to one another, said opposite support straps also disposed between and in substantially transverse relation to said opposite contact walls, said opposite support straps being provided between and connected with one of said pairs of upper and lower opposed portions of said opposite contact walls such that a complete insertion of the male prong into said central passageway provides said electrical contact of the male prong with at least four separate spaced apart portions of said body member of said electrical terminal.

7. The electrical terminal as recited in claim 6, wherein said upper opposed portions are spaced apart and said lower opposed portions are spaced apart at their respective opposed middle section at distances less than the width of the male prong of the electrical plug such that the placement of said opposite support straps between said upper and lower opposed portions but connection to only said upper opposed portions results in a forceable spreading apart of said upper opposed portions from one another by said partial insertion of the male prong through said central passageway between said upper opposed portions and a forceable spreading apart of said lower opposed portions from one another by said complete insertion of the male prong between said upper and lower opposed portions whereby an improved electrical contact is make with the male prong at four separate spaced apart portions of said body member.

8. The electrical terminal as recited in claim 6, further comprising:

an attachment member connected to one of said support straps of said body member for fastening said body member to a mounting member disposed within the electrical receptacle assembly.

9. The electrical terminal as recited in claim 8, wherein said attachment member defines a hole for receiving a fastener therethrough.

* * * * *